US008557047B2

(12) United States Patent
Cho et al.

(10) Patent No.: US 8,557,047 B2
(45) Date of Patent: Oct. 15, 2013

(54) DEVICE AND METHOD FOR PREVENTING FOREIGN MATTERS FROM ADHERING IN DISHWASHER

(75) Inventors: Inhaeng Cho, Changwon-si (KR); Jounghun Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 82 days.

(21) Appl. No.: 12/939,682

(22) Filed: Nov. 4, 2010

(65) Prior Publication Data

US 2011/0041877 A1 Feb. 24, 2011

Related U.S. Application Data

(62) Division of application No. 10/555,598, filed as application No. PCT/KR2005/001093 on Jun. 20, 2005, now abandoned.

(30) Foreign Application Priority Data

Jun. 24, 2004 (KR) ..... 10-2004-0047784

(51) Int. Cl.
*B08B 7/04* (2006.01)

(52) U.S. Cl.
USPC ..... 134/18; 134/25.1; 134/25.2

(58) Field of Classification Search
None
See application file for complete search history.

(56) References Cited

U.S. PATENT DOCUMENTS 4,795,102 A * 1/1989 Jordan et al. ..... 241/46.012
5,550,445 A * 8/1996 Nii ..... 318/153
5,904,163 A * 5/1999 Inoue et al. ..... 134/56 D
2003/0029947 A1 * 2/2003 Strutz et al. ..... 241/46.013
2005/0056480 A1 * 3/2005 Sugiyama et al. ..... 180/421

FOREIGN PATENT DOCUMENTS

| | | |
|---|---|---|
| DE | 3626351 | 2/1988 |
| DE | 43 03 479 | 8/1994 |
| DE | 100 57 465 | 5/2001 |
| DE | 69433740 | 5/2005 |
| EP | 0 079 752 A1 | 5/1983 |
| EP | 0 454 640 A1 | 10/1991 |
| EP | 1 256 308 | 11/2002 |
| EP | 1256398 | 11/2002 |
| GB | 771186 | 3/1957 |

* cited by examiner

*Primary Examiner* — Nicole Blan
(74) *Attorney, Agent, or Firm* — McKenna Long & Aldridge LLP

(57) ABSTRACT

Device and method for preventing foreign matters from adhering in a dishwasher, the device including a circulating pump including a washing motor for providing a driving source to pump up washing water from a sump, an impeller designed to receive driving force from the washing motor and rotate for pumping the washing water from the sump to spray nozzles, and a disposer designed to receive driving force from the washing motor and rotate, for removing foreign matters introduced together with the washing water, sensing means for sensing a rotation speed of the washing motor, and a system control unit for controlling a rotation direction and/or speed of the washing motor according to the rotation speed sensed at the sensing means, thereby preventing the washing motor from being restricted by food remnants to improve product reliability by providing means for effective removal of the food remnants adhered to the washing motor.

4 Claims, 4 Drawing Sheets

DEVICE AND METHOD FOR PREVENTING FOREIGN MATTERS FROM ADHERING IN DISHWASHER

CROSS-REFERENCE TO RELATED APPLICATIONS

This application is a divisional application of U.S. patent application Ser. No. 10/555,598, filed Feb. 16, 2007 now abandoned, which claims priority to International Application No. PCT/KR2005/001093, Filed on Jun. 20, 2005, as well as Korean Application Nos. P 2004-47784, filed on Jun. 24, 2004, all of which are incorporated by referenced in their entirety herein.

TECHNICAL FIELD

The present invention relates to dishwashers, and more particularly, to device and method for preventing foreign matters from adhering in a dishwasher, for preventing food remnants from adhering to a washing motor which is a driving source of a circulating pump.

BACKGROUND ART

In general, the dishwasher removes food remnants from dishes, automatically. The dishwasher is provided with a box shaped body with an opened front and a cavity therein for washing dishes, and a door for opening/closing the opened front of the body.

In an upper, and lower portions of the cavity, there are dish baskets for placing the dishes therein during washing the dishes.

Under the cavity, there is a sump for holding of washing water, a circulating pump for circulating the washing water from the sump, and a discharge pump for discharging the washing water.

In the cavity, there are a plurality of nozzles for receiving water through a spray duct connected to the circulating pump, and spraying the water to the dish baskets, for washing the dishes.

There is a discharge pipe connected to an outlet of the discharge pump, for discharging washing water from the sump to an outside of dishwasher after finishing the washing.

Therefore, upon putting the circulating water into operation after water is supplied from an external water supply source, water held in the sump is supplied to the spray nozzle through the spray duct.

Then, as the water is sprayed in many directions through the spray nozzle, the dishes in the dish baskets are washed, and when the discharge pump is operated following finish of the washing cycle, the washing water is discharged to an outside of the dishwasher.

However, with regard to the circulating pump in the related art dishwasher which pumps the washing water, if food remnants are introduced into the circulating pump, the food remnants are liable to adhere to the vicinity of the washing motor.

If the food remnants deposit on the washing motor, a speed of the motor is reduced, to reduce pumping of the washing water, which impairs a dish washing performance.

DISCLOSURE OF INVENTION

Accordingly, the present invention is directed to device and method for preventing foreign matters from adhering in a dishwasher that substantially obviates one or more problems due to limitations and disadvantages of the related art.

An object of the present invention is to provide device and method for preventing foreign matters from adhering in a dishwasher, in which a problem of food remnants introduced into a circulating pump is solved effectively, to prevent a motor from being restricted by the food remnants.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a device for preventing foreign matters from adhering in a dishwasher includes a circulating pump including a washing motor for providing a driving source to pump up washing water from a sump, an impeller designed to receive driving force from the washing motor and rotate for pumping the washing water from the sump to spray nozzles, and a disposer designed to receive driving force from the washing motor and rotate, for removing foreign matters introduced together with the washing water, sensing means for sensing a rotation speed of the washing motor, and a system control unit for controlling a rotation direction and/or speed of the washing motor according to the rotation speed sensed at the sensing means.

The sensing means is a hole sensor mounted on the washing motor.

The impeller and the disposer are mounted on a rotation shaft of the washing motor on a straight line so that the impeller and the disposer rotate together with the washing motor.

The disposer is mounted on the rotation shaft between the washing motor and the impeller, and includes at least one blade for rotating and smashing foreign matters introduced together with the washing water.

The system control unit determines that the washing motor is in a restricted state if the rotation speed of the washing motor sensed is lower than a preset level, and, preferably, changes the present rotation direction of the washing motor in an opposite direction, or alternates the rotation direction of the washing motor, repeatedly.

In another aspect of the present invention, a method for preventing foreign matters from adhering in a dishwasher includes a first step for rotating a washing motor of a circulating pump in a first direction upon starting of a washing cycle, and sensing rotation speed of the washing motor at fixed intervals, and a second step for controlling a rotation direction of the washing motor according to the rotation speed of the washing motor sensed.

The first step includes the steps of setting the rotation direction of the washing motor to the first direction upon reception of a cycle starting order from a user for pumping up the washing water, starting rotation of the washing motor in the set first direction, and reading the rotation speed of the washing motor at fixed intervals during the washing motor is rotated in the first direction.

The second step includes the steps of performing the washing cycle while maintaining the rotation direction of the washing motor in the first direction if the rotation speed of the washing motor sensed is higher than a preset level, and determining that the washing motor is in a restricted state if the rotation speed of the washing motor sensed is lower than the preset level, and changing the rotation direction of the washing motor for a preset time period, to perform a foreign matter removal cycle.

In this instance, it is preferable in the foreign matter removal cycle that the present rotation direction of the washing motor is changed to a second direction opposite to the first direction, or alternates the rotation direction of the washing motor in the first, and second directions different from each other.

The second step includes the steps of sensing the rotation speed of the washing motor while rotating the washing motor in the first direction again, if the foreign matter removal cycle is finished, performing the washing cycle while maintaining the rotation direction of the washing motor in the first direction, if the rotation speed of the washing motor sensed after the foreign matter removal cycle is higher than the preset level, and displaying an error state of the washing motor, if the rotation speed of the washing motor sensed after the foreign matter removal cycle is lower than the preset level.

It is to be understood that both the foregoing general description and the following detailed description of the present invention are exemplary and explanatory and are intended to provide further explanation of the invention as claimed.

BRIEF DESCRIPTION OF DRAWINGS

The accompanying drawings, which are included to provide a further understanding of the invention and are incorporated in and constitute a part of this application, illustrate embodiment(s) of the invention and together with the description serve to explain the principle of the invention. In the drawings.

BEST MODE FOR CARRYING OUT THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
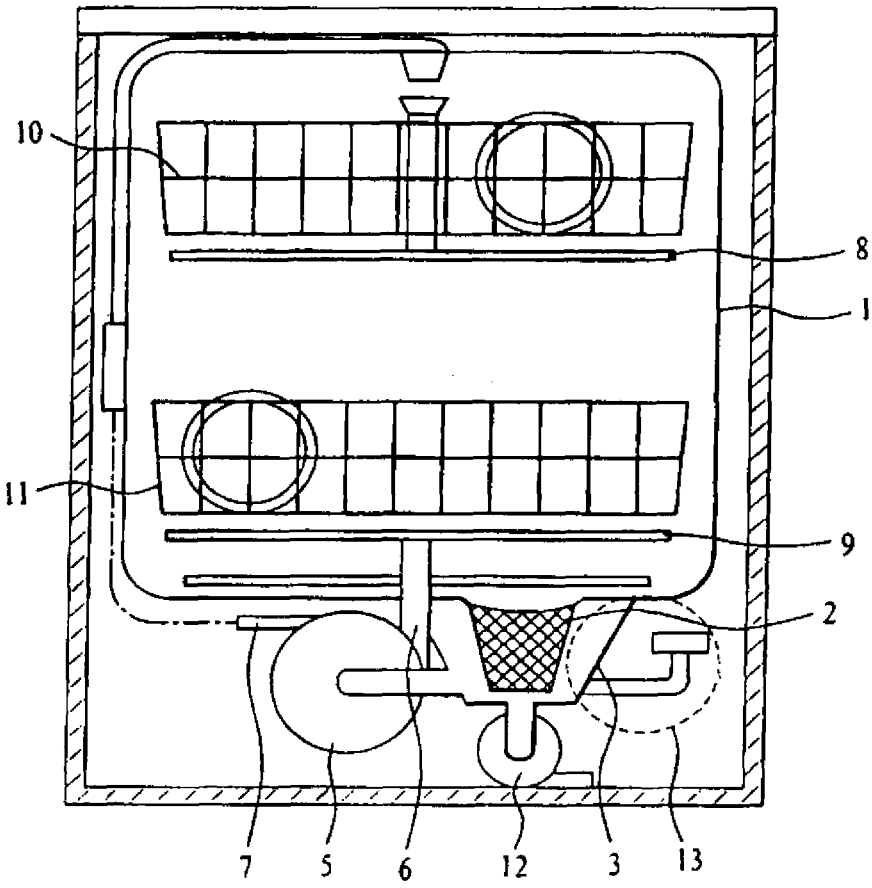
FIG. 1 illustrates a section of a whole dishwasher.
Figure 2:
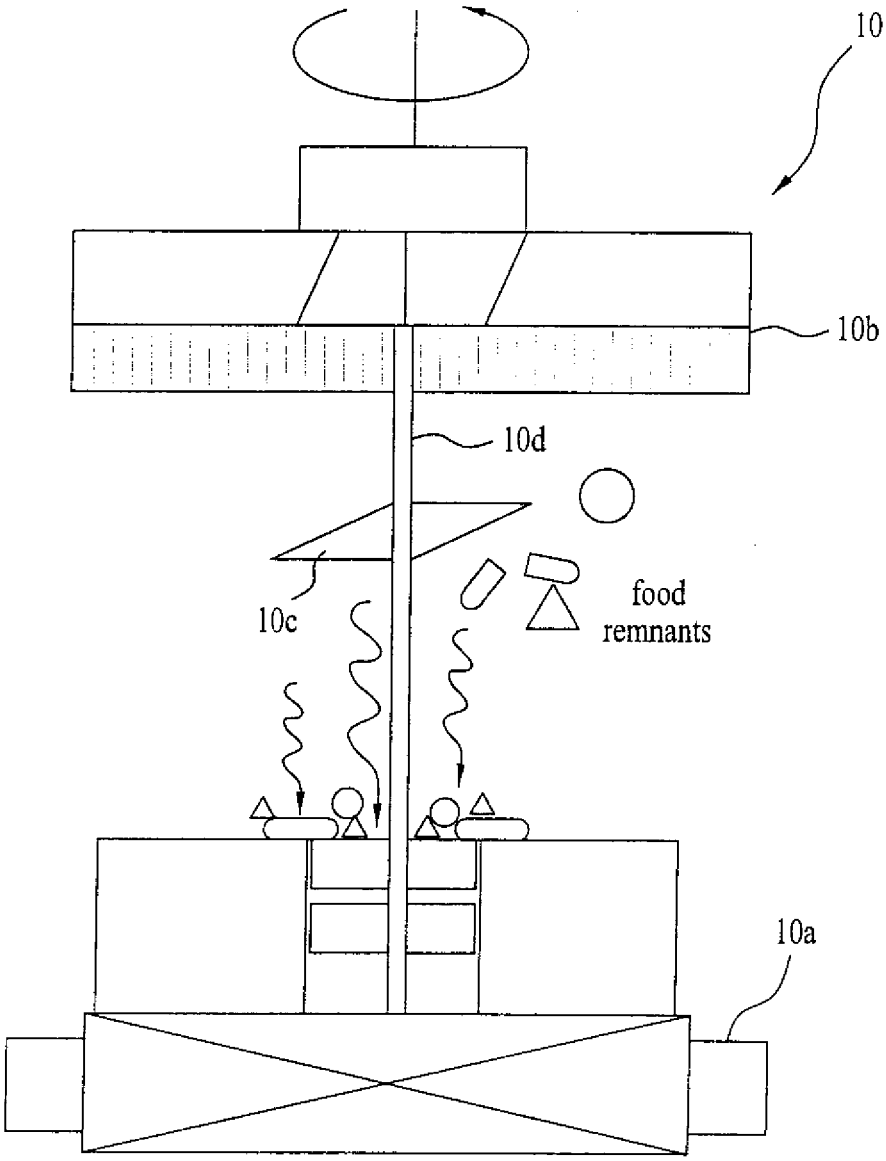
FIG. 2 illustrates a section showing a circulating pump in a dishwasher in accordance with a preferred embodiment of the present invention.

FIG. 1 illustrates a section of a whole dishwasher, and FIG. 2 illustrates a section showing a circulating pump in a dishwasher in accordance with a preferred embodiment of the present invention.

Figure 3:
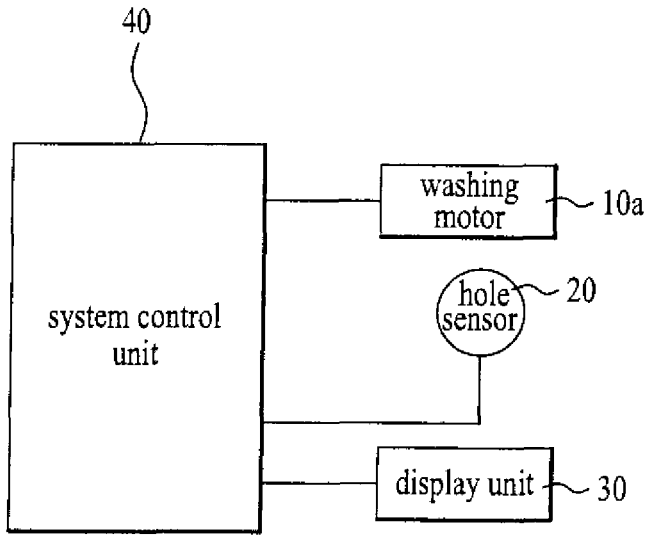
FIG. 3 illustrates a block diagram of a device for preventing foreign matters from adhering in a dishwasher in accordance with a preferred embodiment of the present invention.
Figure 4:
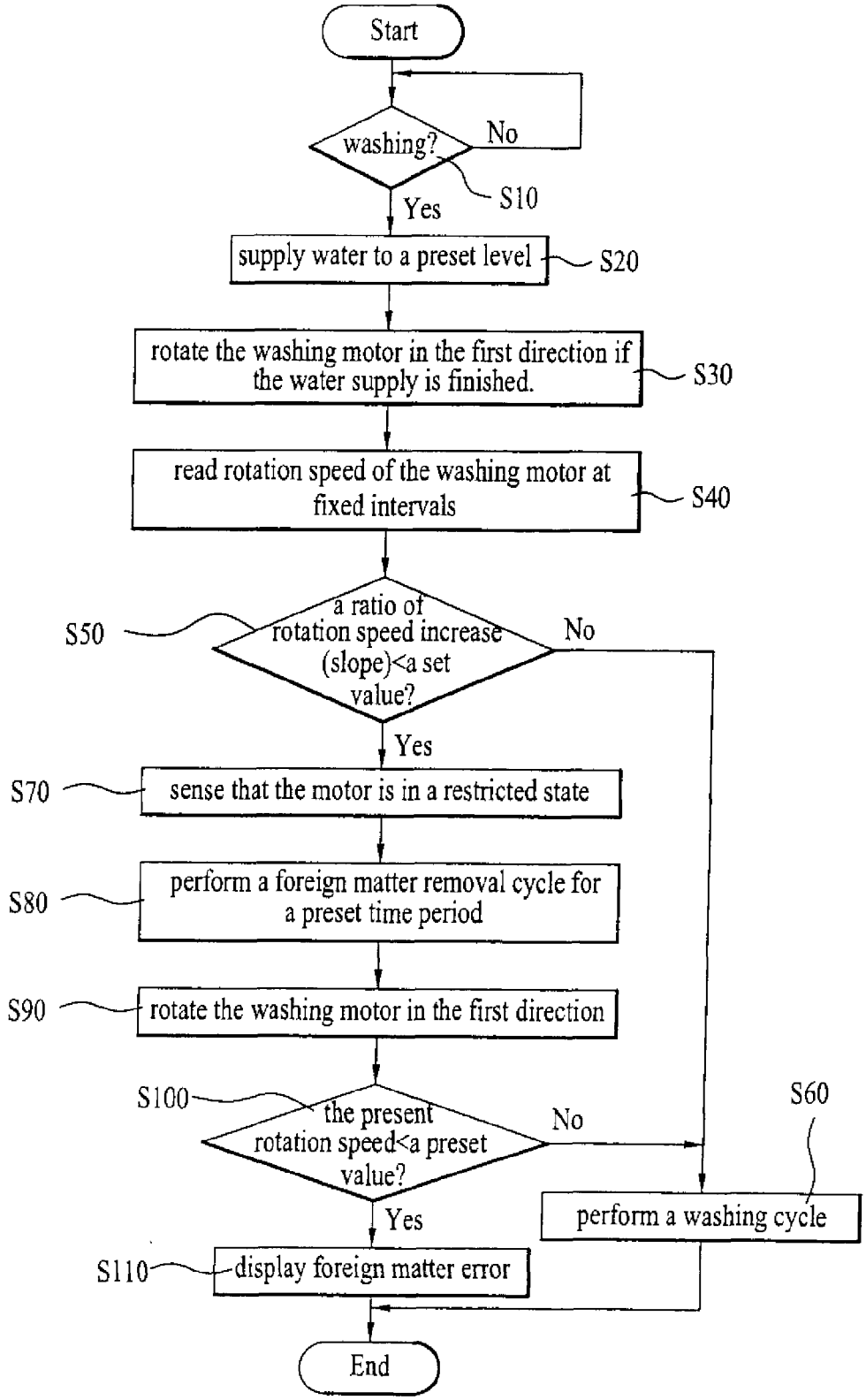
FIG. 4 illustrates a flow chart showing a method for preventing foreign matters from adhering in a dishwasher in accordance with a preferred embodiment of the present invention.

FIG. 3 illustrates a block diagram of a device for preventing foreign matters from adhering in a dishwasher in accordance with a preferred embodiment of the present invention, and FIG. 4 illustrates a flow chart showing a method for preventing foreign matters from adhering in a dishwasher in accordance with a preferred embodiment of the present invention.

A system of the dishwasher, and a detail system and operation of the circulating pump will be described with reference to FIGS. 1 to 3.

Referring to FIG. 1, the dishwasher includes a tub 1 with a predetermined space therein, and an upper rack 4 and a lower rack 5 in the tub 1. Under each of the upper and lower racks 4, and 5, there are upper/lower spray arms 8, and 9 for spraying washing water thereto, respectively.

Under the tub 1, there is a sump 3 for holding washing water, with a filter 2 mounted therein for filtering the washing water. There is a heater (not shown) under the tub 1 for heating washing water.

In the vicinity of the sump 3, there is a circulating pump 10 for circulating the washing water, having a lower flow passage 6 connected to a lower spray arm 9, and an upper flow passage 7 connected to the upper spray arm 8 formed thereon.

Under the sump 3, there is a discharging pump 12 for discharging washing water upon finishing the washing. Water level sensing means 13 is connected to the sump 13 for sensing a water level of the washing water supplied for washing.

Referring to FIG. 2, the circulating pump 10 in accordance with a preferred embodiment of the present invention includes a washing motor 10*a* for providing a driving source to pump up washing water from the sump 3, an impeller 10*b* designed to receive driving force from the washing motor 10*a* and rotate for pumping the washing water from the sump 3 to the upper/lower spray arms 8, and 9, and a disposer 10*c* designed to receive driving force from the washing motor 10*a* and rotate, for removing foreign matters introduced together with the washing water.

It is preferable that the impeller 10*b* and the disposer 10*c* are mounted on a rotation shaft 10*d* of the washing motor 10*a* on a straight line for rotating with the washing motor 10*a*.

It is preferable that the disposer 10*c* is mounted on the rotation shaft 10*d* between the washing motor 10*a* and the impeller 10*b*, and has at least one blade for smashing foreign matters introduced thereto together with washing water by rotation.

Though the disposer 10*c* includes two symmetric blades with respect to the rotation shaft 10*d* as shown in FIG. 2, there may be one or a plurality of blades.

Referring to FIG. 3, the dishwasher having such a circulating pump 10 further includes a hole sensor 20 for sensing a rotation speed of the washing pump 10*a*, a system control unit 40 for rotating the washing motor 10*a* in one direction under a washing cycle order, sensing the rotation speed of the washing motor 10*a* through the hole sensor 20 at fixed intervals during the washing cycle is progressed, and controlling a rotation direction of the washing motor 10*a* according to the rotation speed of the washing motor 10*a* sensed thus, and a display unit 30 for displaying a state of washing, or an error message.

In the foregoing dishwasher, when the user inputs the cycle order taking an amount and kinds of dishes, the system control unit 40 controls various loads. At first, the system control unit 40 opens a water supply valve (not shown), to supply washing water to the sump 3.

When washing water reaches to a preset level in the sump 3, the system control unit 40 stops the water supplied, and puts the heater into operation to heat the washing water in the sump 3.

Then, the system control unit 40 puts the circulating pump 10 into operation, to supply heated washing water to the upper/lower spray arms 8, and 9 through the upper flow passage 7 and the lower flow passage 6.

In this instance, if the impeller 10*b* pumps up the washing water to the upper/lower spray arms 8, and 9 by rotation of the washing motor 10*a*, washing of the dishes in the upper/lower racks 4, and 5 is made as the washing water is sprayed through the upper/lower spray arms 8, and 9.

The operation of the circulating pump 10 will be described in more detail. As the washing cycle is started under the control of the system control unit 40, the washing motor 10*a* starts to rotate in a first direction.

Then, the hole sensor 20 senses the rotation speed of the washing motor 10*a*, and the system control unit 40 reads the rotation speed of the washing motor 10*a* sensed through the hole sensor 20 at fixed intervals.

Then, determining that the washing motor 10*a* is in a restricted state due to adherence of food remnants thereto if a ratio (a slope) of a rotation speed increase of the washing motor 10*a* sensed through the hole sensor 20 after starting of the washing cycle is lower than a preset value, the system control unit 40 changes a rotation direction and/or speed of the washing motor 10*a*, and performs a foreign matter removal cycle for a preset time period.

If the rotation speed of the washing motor 10*a* sensed through the hole sensor 20 is lower than the preset value despite of the foreign matter removal cycle, an error message is displayed on the display unit 30.

A method for preventing foreign matters from adhering in a dishwasher of the present invention described before will be described in more detail with reference to FIG. 4.

Upon reception of user's washing order (S10), water is supplied to a preset water level (S20).

Upon finishing the water supply, the system control unit 40 rotates the washing motor 10*a* in a first direction (left, or right) (S30), and reads the rotation speed of the washing motor 10*a* sensed through the hole sensor 20, periodically (S40).

Then, the system control unit 40 checks the ratio (slope) of rotation speed increase of the washing motor 10*a*, and determines whether the ratio is lower than a preset value or not (S50).

As a result of the determination (S50), if the ratio is higher than the preset value, the washing cycle is performed (S60), and if the ratio is lower than the preset value, the system control unit 40 determines that the washing motor 10*a* is in the restricted state (S70).

Then, when the system control unit 40 determines that the washing motor 10*a* is in the restricted state, the system control unit 40 performs the foreign matter removal cycle for a preset time period in which the system control unit 40 rotates the washing motor 10*a* in a second direction (left, or right) opposite to the first direction, or alternates a rotation direction of the washing motor 10*a* (S80).

That is, if the system control unit 40 determines that the washing motor 10*a* is in the restricted state, the system control unit 40 reverses or alternates a rotation direction of the washing motor 10*a*.

If the rotation direction of the washing motor 10*a* is changed, a vortex is occurred in the circulating pump 10 momentarily, to scatter the food remnants deposited on the washing motor 10*a*, enabling to prevent the foreign matters from adhering thereto.

In order to make effective occurrence of the vortex at the time of the restriction of the washing motor 10*a*, not only the rotation direction, but also rotation speed of the washing motor 10*a* can be changed.

Furthermore, the food remnants introduced into the circulating pump 10 together with the washing water is smashed with a disposer 10*c* on the rotation shall 10*d*.

Eventually, when the washing motor 10*a* is restricted, the food remnants are scattered momentarily by changing the rotation direction of the washing motor 10*a*, and smashed with the disposer 10*c* between the washing motor 10*a* and the impeller 10*b*.

If the foreign matter removal cycle is finished, the washing motor 10*a* is rotated in the first direction again (S90), and the rotation speed of the washing motor 10*a* is read.

If the present rotation speed of the washing motor 10*a* is higher than the preset value, the system control unit 40 proceeds the washing cycle (S100, and S60).

Opposite to this, if the rotation speed of the washing motor 10*a* is lower than the preset value despite of the foreign matter removal cycle, the system control unit 40 determines that the washing motor 10*a* is not freed from the restricted state, and displays an error state for user's notice (S110).

Thus, the present invention prevents the washing motor 10*a* from restricted by food remnants by providing a disposer 10*c* for removal of food remnants from the rotation shaft 10*d* of the washing motor 10*a*, and, in addition to this, the foreign matter removal cycle in which the rotation direction of the washing motor 10*a* is changed according to the rotation speed of the washing motor 10*a*.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

INDUSTRIAL APPLICABILITY

As has been described, the device and method for preventing foreign matters from adhering in a dishwasher of the present invention have the following advantages.

First, a system and an algorithm are provided for effective removal of food remnants adhered to the washing motor in the circulating pump.

Second, the prevention of restriction on the washing motor caused by food remnants, that resolves a factor that impedes a washing performance of the dishwasher, permits to improve product reliability.

What is claimed is:

1. A method for preventing foreign matters from adhering in a dishwasher comprising:

a first step for rotating a washing motor of a circulating pump in a first direction upon starting of a washing cycle, and sensing rotation speed of the washing motor at fixed intervals through a hole sensor; and a second step for controlling a rotation direction of the washing motor through a system controller according to the rotation speed of the washing motor sensed, wherein the second step includes the steps of:

performing the washing cycle while maintaining the rotation direction of the washing motor in the first direction if a ratio of the rotation speed increase of the washing motor sensed is higher than a preset level;

performing a foreign matter removal cycle to change both the rotation direction and the rotation speed of the washing motor for a preset time period if the ratio of the sensed rotation speed increase of the washing motor is lower than the preset level;

sensing the rotation speed of the washing motor while rotating the washing motor in the first direction again, if the foreign matter removal cycle is finished; and performing the washing cycle while maintaining the rotation direction of the washing motor in the first direction, if the ratio of the rotation speed increase of the washing motor sensed after the foreign matter removal cycle is higher than the preset level, displaying an error state of the washing motor, if the rotation speed of the washing motor sensed after the foreign matter removal cycle is lower than the preset level, wherein the ratio of the rotation speed increase is variation of the rotation speed per unit time.

2. The method as claimed in claim 1, wherein the first step includes the steps of:

setting the rotation direction of the washing motor to the first direction upon receipt of a cycle starting order from a user for pumping up the washing water;

starting rotation of the washing motor in the set first direction; and reading the rotation speed of the washing motor at fixed intervals while the washing motor is rotated in the first direction.

3. The method as claimed in claim 1, wherein the performing a foreign matter removal cycle changes the present rotation direction of the washing motor to a second direction opposite to the first direction.

4. The method as claimed in claim 1, wherein performing a foreign matter removal cycle alternates the rotation direction of the washing motor in the first direction and a second direction opposite to the first direction.

* * * * *